US008454408B2

(12) United States Patent
Lischka et al.

(10) Patent No.: US 8,454,408 B2
(45) Date of Patent: Jun. 4, 2013

(54) LOAD CUP SUBSTRATE SENSING

(75) Inventors: David James Lischka, Austin, TX (US); Thomas Lawrence Terry, Cupertino, CA (US)

(73) Assignee: Applied Materials, Inc., Santa Clara, CA (US)

( * ) Notice: Subject to any disclaimer, the term of this patent is extended or adjusted under 35 U.S.C. 154(b) by 867 days.

(21) Appl. No.: 12/621,908

(22) Filed: Nov. 19, 2009

(65) Prior Publication Data

US 2010/0130102 A1 May 27, 2010

Related U.S. Application Data

(60) Provisional application No. 61/118,173, filed on Nov. 26, 2008.

(51) Int. Cl.
*B24B 1/00* (2006.01)

(52) U.S. Cl.
USPC ..... 451/8; 451/9; 451/11; 451/41; 451/288; 451/398; 451/460

(58) Field of Classification Search
USPC ..... 451/5, 8, 9, 11, 41, 54, 285–289, 451/398, 460; 29/279; 414/936
See application file for complete search history.

(56) References Cited

U.S. PATENT DOCUMENTS

| | | | | |
|---|---|---|---|---|
| 6,131,589 | A * | 10/2000 | Vogtmann et al. | 134/113 |
| 6,241,592 | B1 * | 6/2001 | Togawa et al. | 451/288 |
| 6,312,312 | B1 | 11/2001 | Togawa et al. | |
| 7,044,832 | B2 | 5/2006 | Yilmaz et al. | |
| 7,101,253 | B2 | 9/2006 | Olgado | |
| 7,244,168 | B2 * | 7/2007 | Chen et al. | 451/5 |
| 2002/0106972 | A1 * | 8/2002 | Lebel et al. | 451/5 |
| 2004/0127142 | A1 | 7/2004 | Olgado | |
| 2005/0176349 | A1 * | 8/2005 | Yilmaz et al. | 451/8 |
| 2006/0199478 | A1 | 9/2006 | Isobe et al. | |
| 2007/0281589 | A1 * | 12/2007 | Oh et al. | 451/11 |
| 2007/0289124 | A1 | 12/2007 | Oh et al. | |

FOREIGN PATENT DOCUMENTS

| | | |
|---|---|---|
| JP | 2006-303249 | 11/2006 |

OTHER PUBLICATIONS

PCT International Search Report and Written Opinion dated Jun. 23, 2010 for International Application No. PCT/US2009/065433.

* cited by examiner

*Primary Examiner* — George Nguyen
(74) *Attorney, Agent, or Firm* — Patterson & Sheridan, LLP

(57) ABSTRACT

Embodiments of the present invention generally provide a load cup used in the transfer of substrates in a chemical mechanical polishing system. The load cup includes an improved substrate edge sensing mechanism to ensure a substrate is present and correctly positioned in the load cup for transfer to a polishing head. In one embodiment, a lever actuated edge sensing mechanism is provided. In one embodiment, the edge of a substrate contacts a lever, which contacts a sensor to detect that the substrate is present and correctly positioned for exchange with a polishing head. Embodiments of the present invention provide reliable detection, while reducing contact with the feature side of the substrate during substrate transfer.

20 Claims, 6 Drawing Sheets

LOAD CUP SUBSTRATE SENSING

CROSS-REFERENCE TO RELATED APPLICATIONS

This application claims benefit of U.S. provisional patent application Ser. No. 61/118,173, filed Nov. 26, 2008, which is herein incorporated by reference.

BACKGROUND OF THE INVENTION

1. Field of the Invention

Embodiments of the present invention generally relate to a load cup for transferring substrates in a chemical mechanical polishing system.

2. Description of the Related Art

Chemical mechanical polishing generally removes material from a substrate through a chemical or a combined chemical and mechanical process. In a typical chemical mechanical polishing system, a substrate is held by a polishing head in a feature side down orientation above a polishing surface. The polishing head is lowered to place the substrate in contact with the polishing surface. The substrate and polishing surface are moved relative to one another in a predefined polishing motion. A polishing fluid is typically provided on the polishing surface to drive the chemical portion of the polishing activity. Some polishing fluids may include abrasives to mechanically assist in the removal of material from the substrate.

A substrate transfer mechanism, commonly referred to as a load cup, is used to transfer the substrate into the polishing head in a feature side down orientation. As the feature side of the substrate faces the load cup while the substrate is retained therein, care must be taken to avoid damage to the feature side of the substrate through contact with the load cup. For example, the feature side of the substrate may be scratched by surfaces of the load cup that support the substrate. Additionally, particulates generated during the substrate transfer or generated by contact of the substrate to the load cup may be carried on the substrate's surface to the polishing surface. During polishing, these particulates may cause substrate scratching, which results in non-uniform polishing and device defects. Therefore, it is advantageous to minimize substrate to load cup contact.

Substrate damage may also result from misalignment between the load cup and the polishing head. Typically, the load cup and the polishing head are positioned relative to each other with close tolerances to ensure trouble-free exchange. However, if the substrate is not correctly positioned within the load cup when the polishing head is lowered to retrieve the substrate, the polishing head may contact and cause damage to the substrate.

Therefore, improved load cup substrate sensing is needed to reduce damage to the substrate during substrate transfer in a chemical mechanical polishing system.

SUMMARY OF THE INVENTION

In one embodiment of the present invention, a load cup assembly comprises a cup member having a pedestal member disposed therein, a plurality of substrate positioning members disposed about a peripheral region of the pedestal member and extending vertically from the pedestal member, and a plurality of lever actuated substrate sensors disposed on the pedestal member and equally spaced about the peripheral region of the pedestal member. In one embodiment, the plurality of lever actuated substrate sensors each send signals to a controller.

In another embodiment of the present invention, a load cup assembly comprises a cup member having a pedestal member disposed therein, a plurality of substrate positioning members disposed about a peripheral region of the pedestal member and extending vertically from the pedestal member, a plurality of substrate sensors disposed on the pedestal member and equally spaced about the peripheral region of the pedestal member, a plurality of lever arms equally spaced about the peripheral region of the pedestal member, and a plurality of counterweights equally spaced about the peripheral region of the pedestal member. In one embodiment, the plurality of substrate sensors each send signals to a controller. In one embodiment, each lever arm is disposed above a corresponding substrate sensor. In one embodiment, each counterweight is attached to a corresponding lever arm to prevent the lever arm from contacting the substrate sensor therebelow until a substrate is placed in the load cup assembly in contact with an upper surface of the lever arm.

In yet another embodiment of the present invention, a method of transferring a substrate in a chemical mechanical polishing system comprises placing a substrate into a load cup assembly in a feature side down orientation, detecting the presence of the substrate in the load cup assembly, determining the positioning of the substrate in the load cup assembly, and transferring the substrate to a polishing head. In one embodiment, the load cup assembly comprises a cup with a pedestal disposed therein, a plurality of substrate guiding members disposed about a peripheral region of the pedestal and extending upwardly therefrom, and at least three lever actuated sensors equally spaced about the peripheral region of the pedestal. In one embodiment, the presence of the substrate in the load cup assembly is detected by determining if one or more of the lever actuated sensors is actuated by the substrate. In one embodiment, the positioning of the substrate in the load cup assembly is determined by detecting if all of the lever actuated sensors are actuated by the substrate.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention generally provide a load cup used in the transfer of substrates in a chemical mechanical polishing system. The load cup includes an improved substrate edge sensing mechanism to ensure a substrate is present and correctly positioned in the load cup for transfer to a polishing head. In one embodiment, a lever actuated edge sensing mechanism is provided. In one embodiment, the edge of a substrate contacts a lever, which contacts a sensor to detect that the substrate is present and correctly positioned for exchange with a polishing head. Embodiments of the present invention provide reliable detection, while reducing contact with the feature side of the substrate during substrate transfer.

Figure 1:
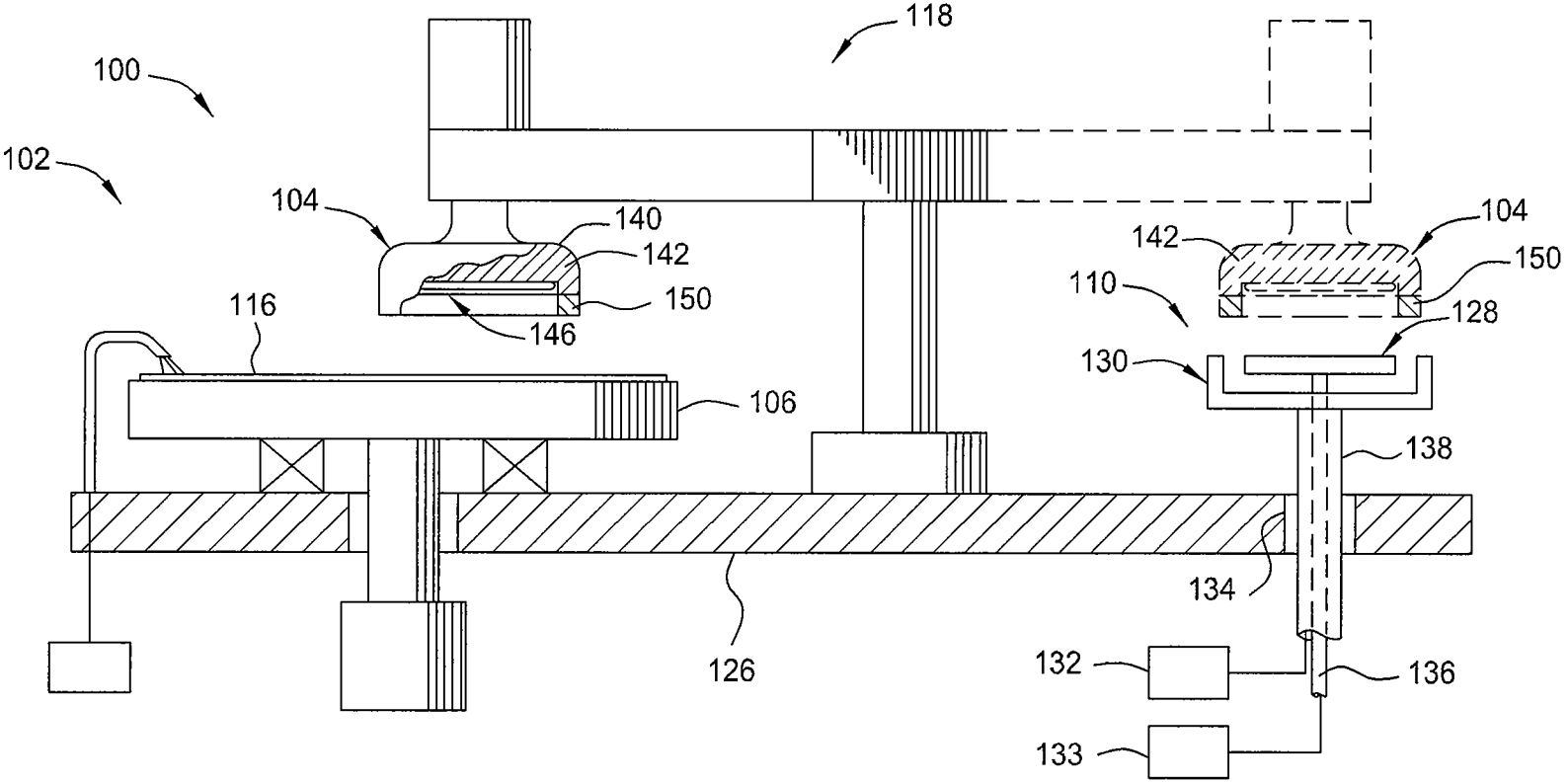
FIG. 1 (PRIOR ART)
FIG. 1 is a partial, schematic, sectional view of a state of the art polishing system.

FIG. 1 is a partial, schematic, sectional view of a state of the art polishing system 100. The polishing system 100 includes a polishing station 102, a polishing head 104, and a load cup 110. The polishing station 102 includes a rotatable platen 106 having a polishing material 116 disposed thereon. The polishing head 104 is supported above the polishing station 102 coupled to a base 126 by a transfer mechanism 118. The transfer mechanism 118 is adapted to position the polishing head 104 selectively over the polishing material 116 or over the load cup 110. The polishing head 104 comprises a housing 140 having an extending lip 142 defining a recess 146. A retaining ring 150 circumscribes the polishing head 104.

The load cup 110 generally includes a pedestal assembly 128 and a cup 130. The pedestal assembly 128 is supported by a shaft 136, which is coupled to an actuator 133. The cup 130 is supported by a shaft 138, which extends through a hole 134 in the base 126 and is coupled to an actuator 132. When transferring a substrate between the load cup 110 and the polishing head 104, the polishing head 104 is generally rotated to above the load cup 110, as shown by dotted lines in FIG. 1. The pedestal assembly 128 may be raised so that the inner surface of the retaining ring 150 mates with the outer surface of the pedestal assembly 128.

Figure 2:
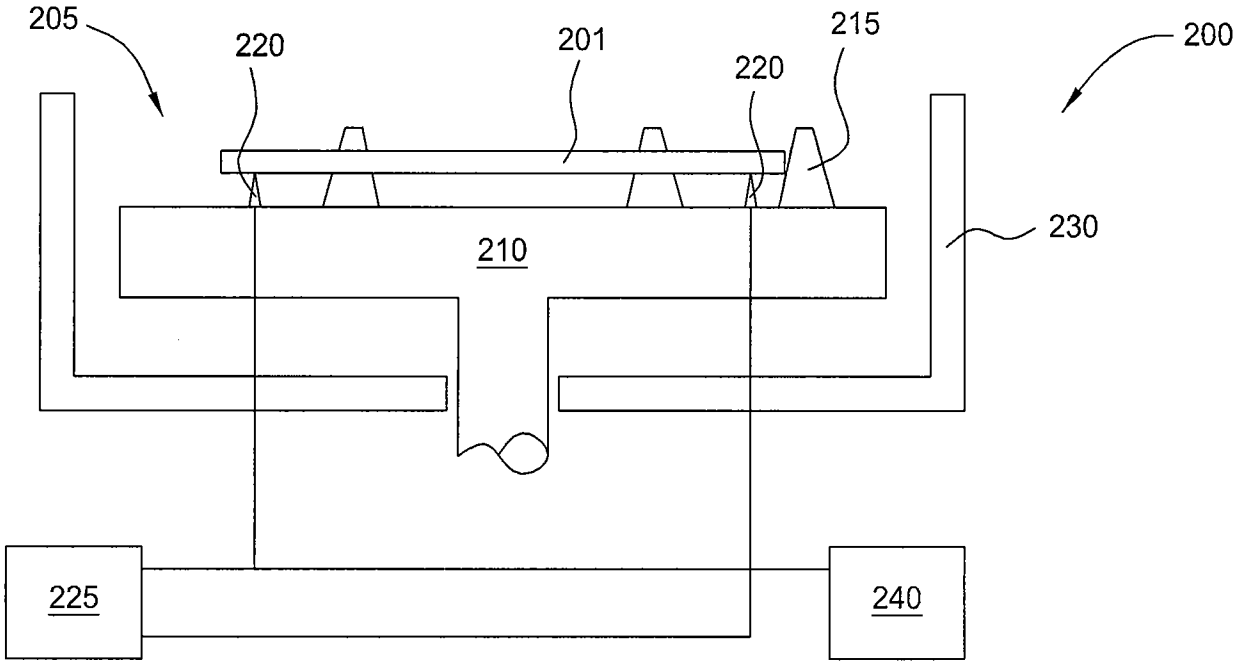
FIG. 2 (PRIOR ART)
FIG. 2 is a schematic, cross-sectional view of a prior art load cup assembly for use in the polishing system of FIG. 1.

FIG. 2 is a schematic, cross-sectional view of a prior art load cup assembly 200 for use in the polishing system 100 of FIG. 1. The load cup assembly 200 generally includes a pedestal assembly 205 and a cup 230. The pedestal assembly 205 includes a pedestal 210 having a plurality of guides 215 extending vertically from the upper surface of the pedestal 210. Typically six guides 215 are provided for guiding a substrate 201 during the process of transferring the substrate 201 from a polishing head to the load cup assembly 200. The guides 215 may be cylindrical members with chambered edges or conical members.

As shown in FIG. 2, the pedestal assembly 205 further includes a plurality of nozzles 220. The nozzles 220 (typically three) are positioned about the periphery of the pedestal 210 such that they contact the feature side of the substrate 201 only in an exclusion zone of the substrate 201. The exclusion zone of the substrate 201 is an outer perimeter region of the feature side of the substrate 201 that has no features formed on it. The nozzles 220 are in fluid communication with a fluid source 240 that supplies a fluid, such as de-ionized water, to the nozzles 220. The nozzles 220 are configured to spray a stream of fluid upwardly toward the substrate 201 as the substrate is being loaded into the load cup assembly 200. Once the substrate 201 contacts all of the nozzles 220 and shuts off the flow of fluid through the nozzles 220, a controller 225 senses back pressure in the nozzles 220 and sends a signal that the substrate 201 is present and properly seated. If the flow of fluid is shut off in at least one, but not all of the nozzles 220, the controller 225 sends a signal that the substrate 201 is present but not properly seated, and the transfer process is interrupted to prevent damage to the substrate 201.

The load cup assembly 200 sensing mechanism and scheme described above works well for detecting that the substrate 201 is present and properly situated for further transfer. However, problems arise when the exclusion zone of the substrate 201 is reduced or eliminated as is the current trend in substrate processing. When the exclusion zone of the substrate 201 is reduced or eliminated, the nozzles 220 contact features of the substrate 201 and may cause unacceptable damage to the substrate 201, resulting in excessive reject rates and increased cost in the manufacturing process. Additionally, the fluid from the nozzles 220 migrates centrally onto features on the substrate 201. If copper is used on the feature side of the substrate 201, unacceptable corrosion bands may form on the copper features between wet and dry areas on the feature side of the substrate 201. Therefore, it is desired to prevent fluid from the nozzles 220 from reaching the feature side of the substrate 201.

Figure 3A:
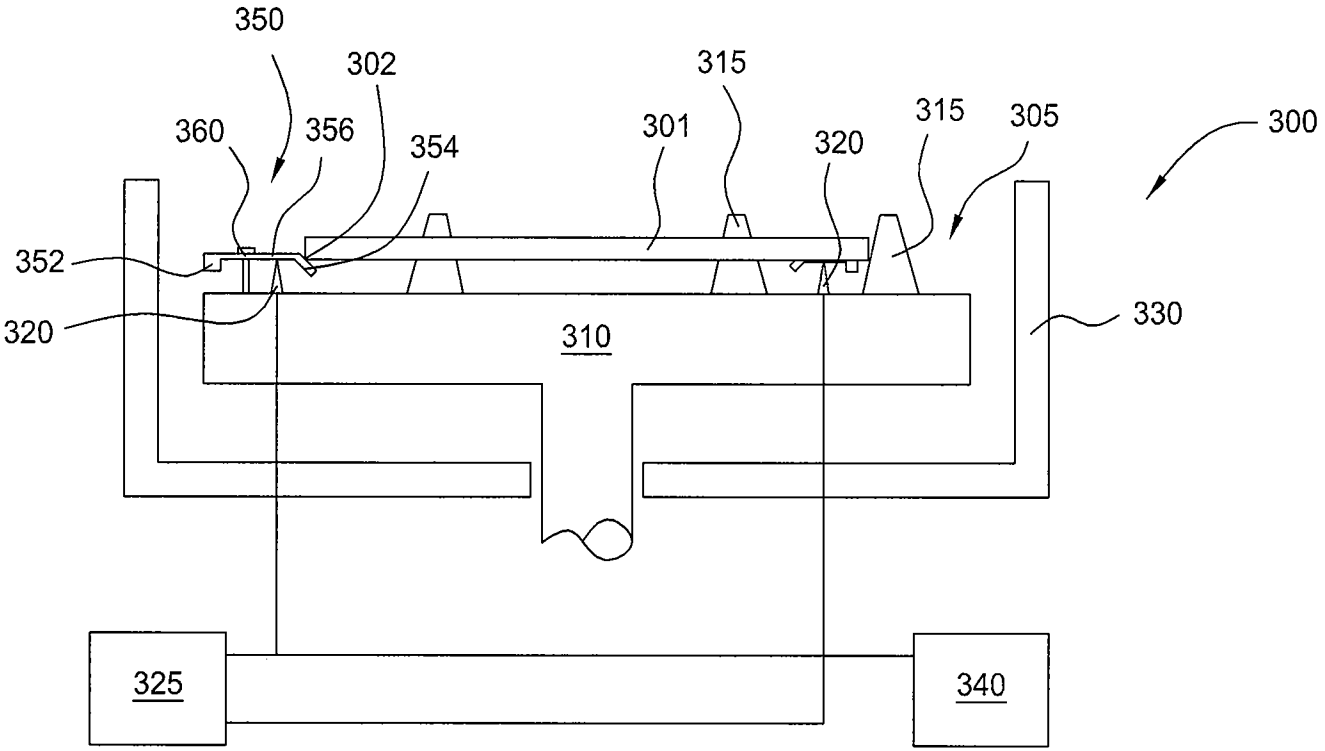
FIG. 3A is a schematic, cross-sectional view of a load cup assembly according to one embodiment of the present invention.
Figure 3B:
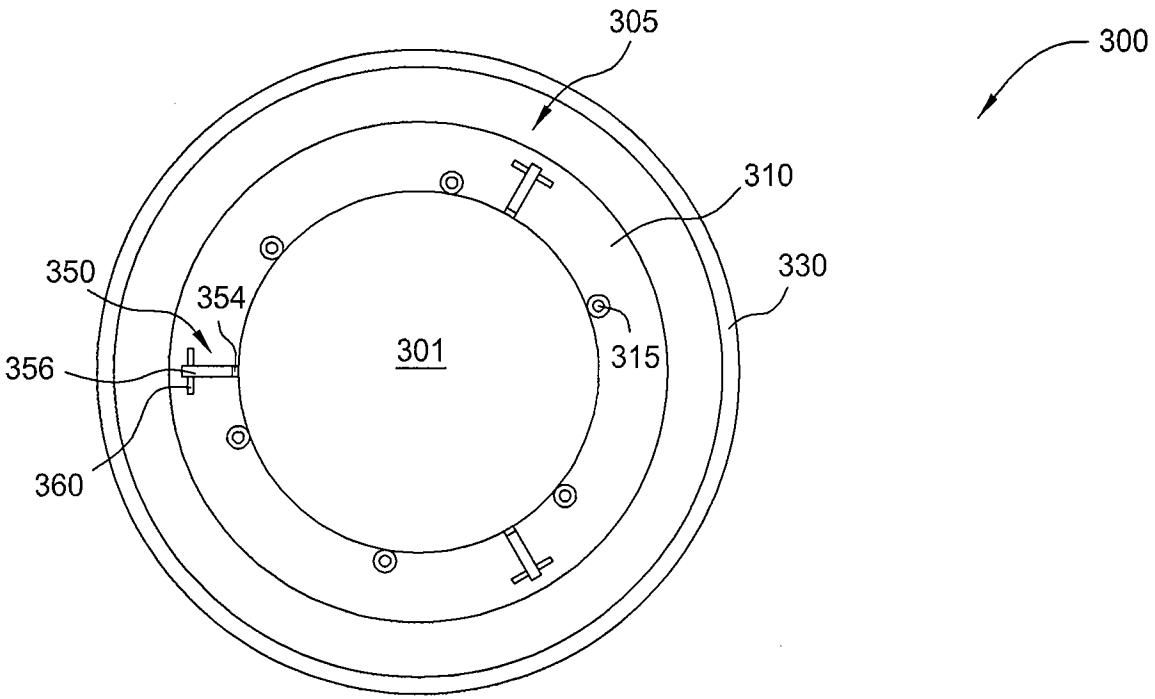
FIG. 3B is a schematic, top view of the load cup assembly in FIG. 3A.

FIG. 3A is a schematic, cross-sectional view and FIG. 3B is a schematic, top view of a load cup assembly 300 according to one embodiment of the present invention. In one embodiment, the load cup assembly 300 comprises a pedestal assembly 305 and a cup 330. In one embodiment, the pedestal assembly 305 includes a pedestal 310 having a plurality of guides 315 extending vertically from the upper surface of the pedestal 310. In one embodiment, three or more guides 315 are provided for guiding a substrate 301 during the process of transferring the substrate from a polishing head to the load cup assembly 300. In one embodiment, six guides 315 are provided. The guides 315 may be cylindrical members with chamfered edges, conical members, elliptical members, spherical members, or other shaped members capable of guiding the edge of the substrate 301 into the load cup assembly 300 without damaging the feature side (down facing side) of the substrate 301.

In one embodiment, the load cup assembly 300 includes a plurality of sensors 320 situated outboard of the plurality of guides 315. Each sensor 320 has a lever 350 positioned thereover. Each lever 350 has a pivot member 360, such as a pin member, disposed therethrough and attached to the pedestal 310. The lever 350 comprises a counterweight feature 352 connected to an angled contact feature 354 via an arm feature 356. The pivot member 360 extends through the arm feature 356 outboard of the sensor 320, which is positioned below the arm feature 356. The counterweight feature 352 is positioned outboard of the pivot member 360. The angled contact feature 354 extends inboard of and downwardly from the arm feature 356. In one embodiment, the lever 350 comprises a plastic material, such as polyetheretherketone (PEEK).

In one embodiment, the sensor 320 comprises a nozzle in fluid communication with a fluid source 340 that supplies a fluid, such as de-ionized water to the nozzle. Each sensor 320 is connected to a controller 325 that detects backpressure in each of the nozzles. In one embodiment, the nozzles comprise a plastic material, such as PEEK.

In one embodiment of the present invention, the sensor 320 comprises a micro switch that sends a signal to the controller 325 when the micro switch is tripped.

In one embodiment, the load cup assembly 300 comprises at least three sensors 320 equally spaced about the perimeter of the pedestal 310. Each lever 350 is situated with the arm feature 356 over the respective sensor 320 and the angled contact feature 354 positioned such that as the substrate 301 is lowered into the load cup assembly 300, the beveled edge 302 of the substrate 301 contacts the angled contact feature 354. The weight of the substrate 301 on the angled contact feature 354 counteracts the weight of the counterweight feature 352 and causes the arm feature 356 to contact the sensor 320.

In one embodiment, the angled contact feature 354 is configured to prevent fluid from the respective nozzle of the sensor 320 from migrating onto the feature surface of the substrate 301.

In one embodiment, when the arm feature 356 contacts the sensor 320, the arm feature 356 blocks the flow of fluid through the nozzle of the sensor 320. Once the substrate 301 contacts all of the levers 350, and each of the levers 350, in turn, shuts off the flow of fluid through the respective nozzle, the controller 325 senses the back pressure in the nozzles and sends a signal that the substrate 301 is present and properly seated. If the flow of fluid is shut off in at least one, but not all of the nozzles, the controller 325 sends a signal that the substrate 301 is present but not properly seated, and the transfer process is interrupted to prevent damage to the substrate 301.

In another embodiment, when the arm feature 356 contacts the sensor 320, the arm feature 356 trips the micro switch of the sensor 320. Once the substrate 301 contacts all of the levers 350 and each of the levers 350, in turn, trips the respective micro switch, the controller 325 sends a signal that the substrate 301 is present and properly seated. If at least one, but not all of the micro switches, is tripped, the controller 325 sends a signal that the substrate 301 is present but not properly seated, and the transfer process is interrupted to prevent damage to the substrate 301.

Figure 4A:
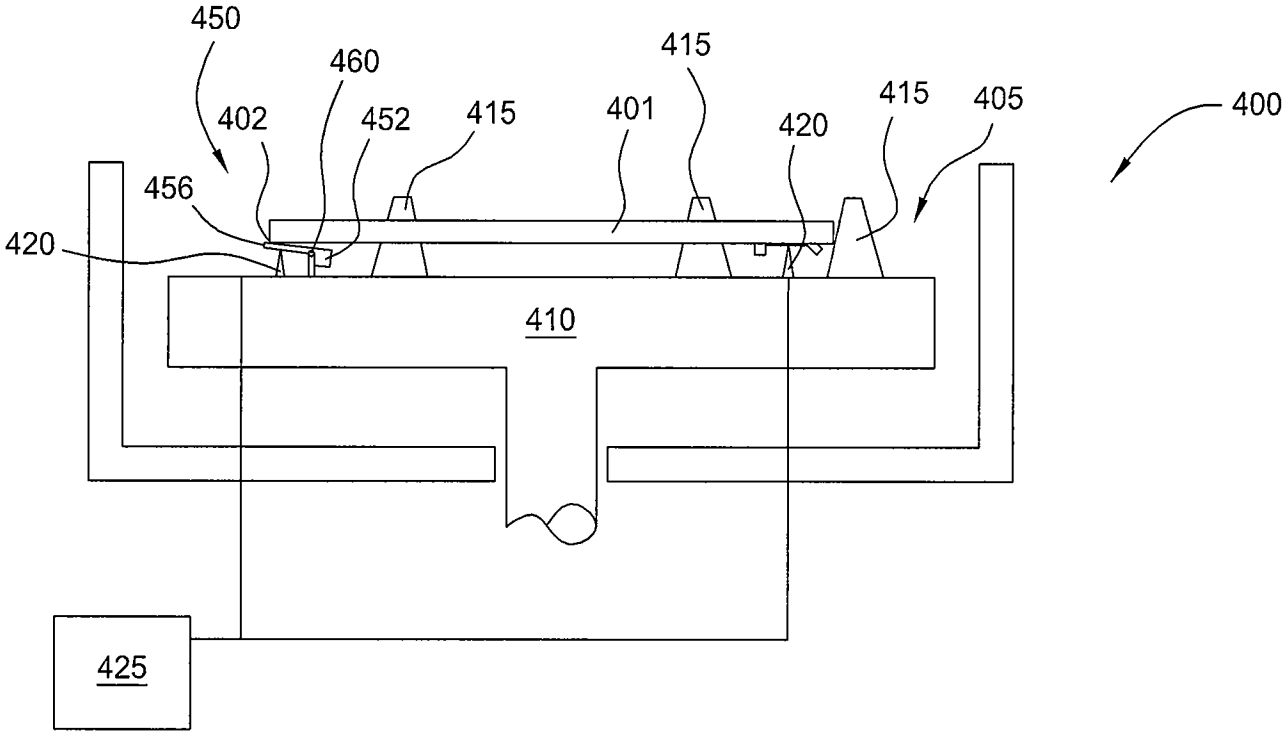
FIG. 4A is a schematic, cross-sectional view of a load cup assembly according to another embodiment of the present invention.
Figure 4B:
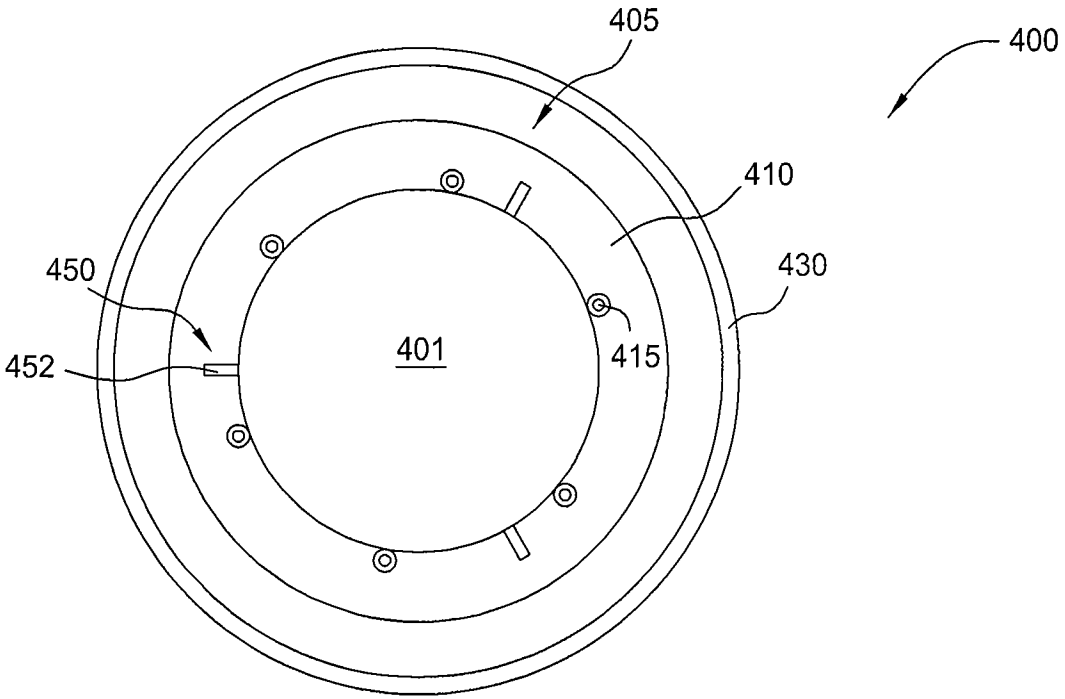
FIG. 4B is a schematic, top view of the load cup assembly in FIG. 4A.

FIG. 4A is a schematic, cross-sectional view and FIG. 4B is a schematic, top view of a load cup assembly 400 according to another embodiment of the present invention. In one embodiment, the load cup assembly 400 comprises a pedestal assembly 405 and a cup 430. In one embodiment, the pedestal assembly 405 includes a pedestal 410 having a plurality of guides 415 extending vertically from the upper surface of the pedestal 410. In one embodiment, three or more guides 415 are provided for guiding a substrate 401 during the process of transferring the substrate 401 from a polishing head to the load cup assembly 400. In one embodiment, six guides 415 are provided. The guides 415 may be cylindrical members with chamfered edges, conical members, elliptical members, spherical members, or other shaped members capable of guiding the edge of the substrate 401 into the load cup assembly 400 without damaging the feature side (down facing side) of the substrate 401.

In one embodiment, the load cup assembly 400 includes a plurality of sensors 420 situated inboard of the plurality of guides 415. Each sensor 420 has a lever 450 positioned thereover. Each lever 450 has a pivot member 460, such as a pin member, disposed therethrough and attached to the pedestal 410. The lever 450 comprises a counterweight feature 452 connected to an arm feature 456. The pivot member 460 extends through the counterweight feature 452 inboard of the sensor 420, which is positioned below the arm feature 456. The bulk of the counterweight feature 452 is positioned inboard of the pivot member 460, such that the arm feature 456 does not actuate the sensor 420 when no substrate 401 is present. The arm feature 456 extends outboard of and upwardly from the pivot member 420. In one embodiment, the lever 450 comprises a plastic material, such as polyetheretherketone (PEEK).

In one embodiment of the present invention, the sensor 420 comprises a micro switch that sends a signal to a controller 425 when the micro switch is tripped.

In one embodiment, the load cup assembly 400 comprises at least three sensors 420 equally spaced about an inner perimeter of the pedestal 410. Each lever 450 is situated with the arm feature 456 over the respective sensor 420 such that as the substrate 401 is lowered into the load cup assembly 400, the beveled edge 402 of the substrate 401 contacts the arm feature 456. The weight of the substrate 401 on the arm feature 456 counteracts the weight of the counterweight feature 452 and causes the arm feature 456 to contact the sensor 420.

In one embodiment, when the arm feature 456 contacts the sensor 420, the arm feature 456 trips the micro switch of the sensor 420. Once the substrate 401 contacts all of the levers 450 and each of the levers 450, in turn, trips the respective micro switch, the controller 425 sends a signal that the substrate 401 is present and properly seated. If at least one, but not all of the micro switches is tripped, the controller 425 sends a signal that the substrate 401 is present but not properly seated, and the transfer process is interrupted to prevent damage to the substrate 401.

Therefore, embodiments of the present invention provide a robust and reliable substrate sensing mechanism for a load cup in a chemical mechanical polishing system. Embodiments of the present invention further detect the presence and position of a substrate transferred to a load cup, while eliminating contact to the feature side of the substrate. Additionally, embodiments of the present invention provide substrate detection and position in a load cup, while preventing the migration of fluid onto the feature side of the substrate.

While the foregoing is directed to embodiments of the present invention, other and further embodiments of the invention may be devised without departing from the basic scope thereof, and the scope thereof is determined by the claims that follow.

The invention claimed is:

1. A load cup assembly, comprising:

a cup member having a pedestal member disposed therein;

a plurality of substrate positioning members disposed about a peripheral region of the pedestal member and extending vertically from the pedestal member; and a plurality of lever actuated substrate sensors disposed on the pedestal member and equally spaced about the peripheral region of the pedestal member, wherein the plurality of lever actuated substrate sensors each send signals to a controller.

2. The load cup assembly of claim 1, wherein each lever actuated substrate sensor comprises a lever arm attached to a counterweight, wherein the lever arm is disposed over a sensor member.

3. The load cup assembly of claim 2, wherein each lever actuated substrate sensor further comprises an angled contact feature attached to the lever arm opposite the counterweight.

4. The load cup assembly of claim 3, wherein the sensor members are disposed outboard of the plurality of substrate positioning members, and wherein the counterweights are disposed outboard of the sensor members.

5. The load cup assembly of claim 4, wherein each lever arm has a pivot member disposed therethrough outboard of its respective sensor member.

6. The load cup assembly of claim 5, wherein each sensor member comprises a nozzle in fluid communication with a fluid source, and wherein each angled contact feature extends inwardly and downwardly from the lever arm such that fluid exiting the nozzle is prevented from migrating inboard of the angled contact feature.

7. The load cup assembly of claim 6, wherein the controller senses back pressure in each of the nozzles.

8. The load cup assembly of claim 5, wherein each sensor member comprises a micro switch configured to send signals to the controller when the micro switch is tripped.

9. The load cup assembly of claim 2, wherein the sensor members are disposed inboard of the plurality of substrate positioning members, and wherein the counterweights are disposed inboard of the sensor members.

10. The load cup assembly of claim 9, wherein a pivot member is disposed through the outboard side of each counterweight.

11. The load cup assembly of claim 10, wherein each sensor member comprises a micro switch configured to send signals to the controller when the micro switch is tripped.

12. A load cup assembly, comprising;

a cup member having a pedestal member disposed therein;

a plurality of substrate positioning members disposed about a peripheral region of the pedestal member and extending vertically from the pedestal member;

a plurality of substrate sensors disposed on the pedestal member and equally spaced about the peripheral region of the pedestal member, wherein the plurality of substrate sensors each send signals to a controller;

a plurality of lever arms equally spaced about the peripheral region of the pedestal member, wherein each lever arm is disposed above a corresponding substrate sensor; and a plurality of counterweights equally spaced about the peripheral region of the pedestal member, wherein each counterweight is attached to a corresponding lever arm to prevent the lever arm from contacting the substrate sensor therebelow until a substrate is placed in the load cup assembly in contact with an upper surface of the lever arm.

13. The load cup assembly of claim 12, wherein the substrate sensors are disposed inboard of the substrate positioning members, and wherein the counterweights are disposed inboard of the substrate sensors.

14. The load cup assembly of claim 13, wherein each substrate sensor is a micro switch, wherein each micro switch is configured to send signals to the controller when the micro switch is tripped.

15. The load cup assembly of claim 12, wherein the substrate sensors are disposed outboard of the substrate positioning members, and wherein the counterweights are disposed outboard of the substrate sensors.

16. The load cup assembly of claim 15, wherein each substrate sensor comprises a nozzle connected to a fluid source, and wherein the controller detects backpressure within each nozzle.

17. A method of transferring a substrate in a chemical mechanical polishing system, comprising:

placing a substrate into a load cup assembly in a feature side down orientation, wherein the load cup assembly comprises a cup with a pedestal disposed therein, a plurality of substrate guiding members disposed about a peripheral region of the pedestal and extending upwardly therefrom, and at least three lever actuated sensors equally spaced about the peripheral region of the pedestal;

detecting the presence of the substrate in the load cup assembly, wherein the presence of the substrate in the load cup assembly is detected by determining if one or more of the lever actuated sensors is actuated by the substrate;

determining the positioning of the substrate in the load cup assembly, wherein the positioning of the substrate in the load cup assembly is determined by detecting if all of the lever actuated sensors are actuated by the substrate; and transferring the substrate to a polishing head.

18. The method of claim 17, wherein the transferring the substrate to a polishing head is interrupted if any of the lever actuated sensors is not actuated by the substrate.

19. The method of claim 18, wherein each lever actuated sensor comprises a sensor member disposed below a lever having a counterweight attached thereto such that the sensor member is actuated by the lever when a substrate is positioned thereon, and wherein the sensor member is a micro switch that sends signals to a controller when the micro switch is tripped.

20. The method of claim 18, wherein each lever actuated sensor comprises a sensor member disposed below a lever having a counterweight attached thereto such that the sensor member is actuated by the lever when a substrate is positioned thereon, wherein the sensor member comprises a nozzle attached to a fluid source, wherein a controller senses backpressure in the nozzle, and wherein the lever prevents the fluid exiting the nozzle from migrating onto the feature side of the substrate.

* * * * *